United States Patent [19]

Cooper et al.

[11] Patent Number: 4,993,339

[45] Date of Patent: Feb. 19, 1991

[54] UPHAULER FOR BOARDSAILING

[76] Inventors: Frank H. Cooper, 896 Via Ondulando, Ventura, Calif. 93003; Donald E. Watkins, 6837 Zelzah Ave., Ventura, Calif. 93001

[21] Appl. No.: 474,341

[22] Filed: Feb. 2, 1990

[51] Int. Cl.[5] ..... B63B 35/00

[52] U.S. Cl. ..... 114/39.2; 114/91

[58] Field of Search ..... 114/39.2, 91, 97, 102

[56] References Cited

U.S. PATENT DOCUMENTS 4,938,161 7/1990 Blackmer ..... 114/91 X

FOREIGN PATENT DOCUMENTS 2562863 10/1985 France ..... 114/91

2575720 7/1986 France ..... 114/39.2

*Primary Examiner*—Sherman Basinger

*Attorney, Agent, or Firm*—Edgar W. Averill, Jr.

[57] ABSTRACT

An improved uphauler assembly for use in facilitating the uphauling of a sail of a sailboard by a user wearing a harness including a harness hook. The assembly includes an uphauler rope or line formed in a large loop having a small loop at one end. The large loop is held in a pulley affixed near the front of the boom. The smaller loop is placed in the harness hook, and one end of the large loop is pulled, thereby raising the sail from the surface of the water with only half the force necessary with the usual method. An elastic cord retracts the assembly against the front of the mast when the unit is not in use.

7 Claims, 2 Drawing Sheets

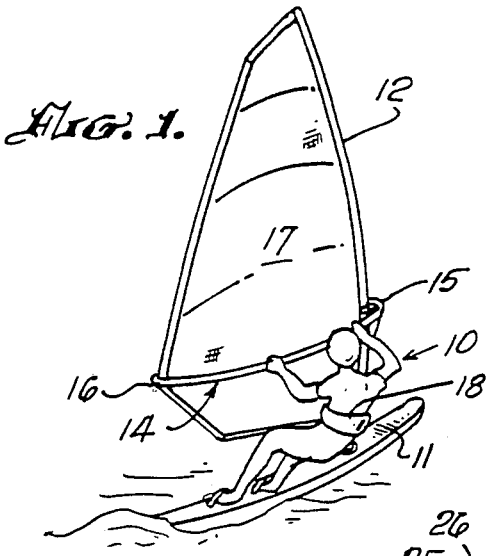
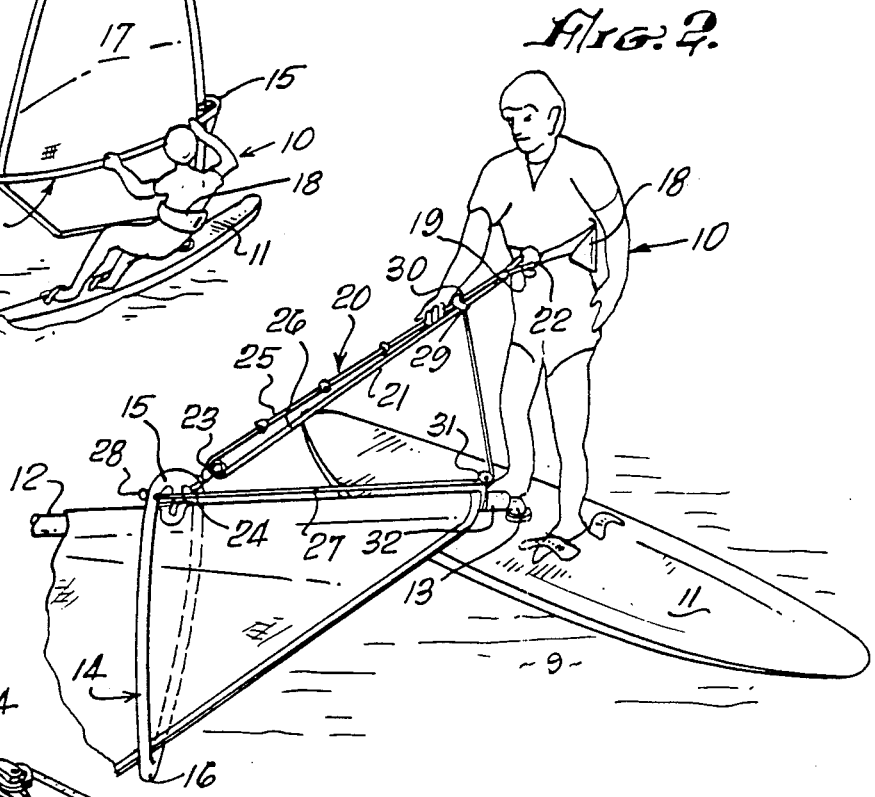
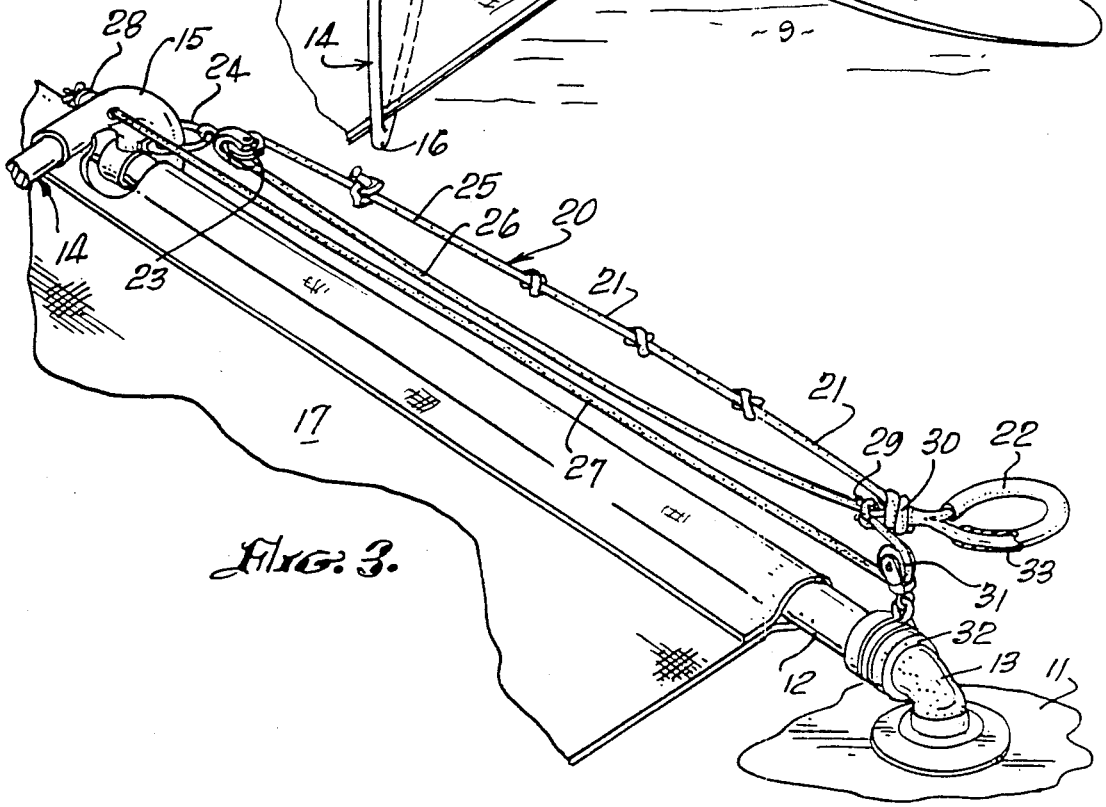
FIG. 3.

UPHAULER FOR BOARDSAILING

BACKGROUND OF THE INVENTION

The field of the invention is sporting goods, and the invention relates more particularly to the sport of boardsailing. Boardsailing utilizes a sailboard which is a special surfboard with a mast and sail that is mounted on a swivel, universal joint. When the mast is not held upright by the user, the mast and sail will fall by gravity into the water.

Boardsailing equipment includes a boom which is a double unit running on both sides of the sail. The double boom is fastened together at the forward end and securely fastened to the mast so the mast will rotate with the boom.

An arduous task in the sport of boardsailing involves raising the sail and mast from the surface of the water. This is particularly true for learners since in learning the sport, it is common to capsize many times. After capsizing, the sailboard sail floats on the surface of the water. Typically, a single uphaul line is affixed to the front of the boom, and this line is grasped, and the sail is pulled out of the water by pulling on the line from the front of the boom. Because the sail is resting in the water, it requires quite a bit of strength to lift the sail out of the water.

SUMMARY OF THE INVENTION

It is an object of the present invention to provide an uphauler requiring about half the force of a normal uphauler to pull the sail from the water.

The present invention is for an improved uphauler assembly for use in facilitating the uphauling of a sail of a sailboard by a user wearing a harness including a harness hook. The sailboard is of the type having a board, a mast connected to the board, a sail affixed to the mast and a boom also affixed to the mast. The improvement comprises one upper pulley affixed near the front of the boom for the uphauler assembly and a lower pulley affixed onto the lower base of the mast for the elastic cord. An uphauler line is formed in a large, flat loop, and the uphauler line passes through the upper pulley and has a small loop at one end. An elastic cord is affixed near the front of the boom and passes through the lower pulley and is affixed to the uphauler line near the small loop thereof. The elastic cord is of sufficient length and elasticity to pull the uphauler line against the front of the mast when it is not being used and yet stretches to permit the small loop to be hooked to the harness hook worn by the user while the sail is being lifted from the water. To raise the sail, one side of the large loop is grasped when the small loop is in the harness hook, and this one side is pulled thereby utilizing the pulley effect to reduce the force required to lift the sail by fifty percent. Once the sail has been raised, the boom is grasped by one of the user's hands and this releases the tension in the uphauler small loop, and the elastic cord pulls the small loop from the harness hook and pulls the uphauler assembly against the front of the mast for storage.

BRIEF DESCRIPTION OF THE DRAWINGS

FIG. 1 is a perspective view showing a boardsailer in the process of sailing.

FIG. 2 shows a boardsailer standing on a sailboard with the sail in the water.

FIG. 3 is an enlarged perspective view showing the details of the uphauler assembly of the present invention.

DESCRIPTION OF THE PREFERRED EMBODIMENT

Figure 5:
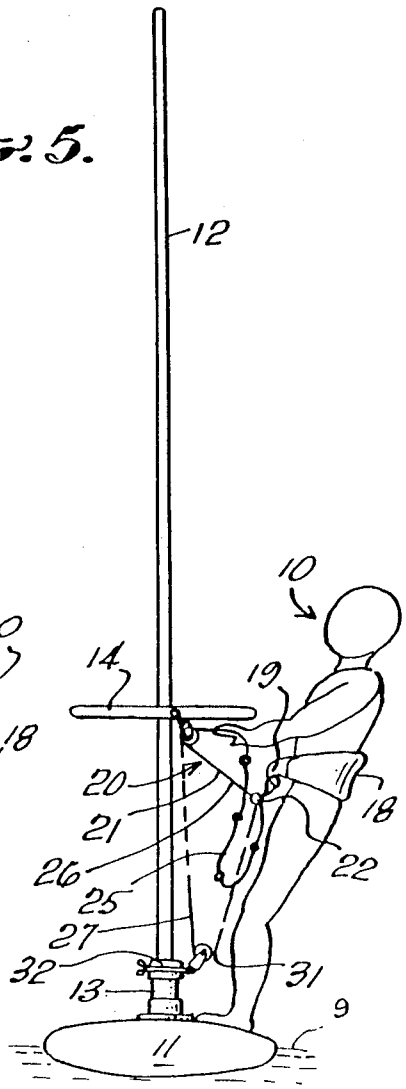
FIG. 5 is a view analogous to FIG. 4 showing the mast in a vertical position.

A boardsailer in action is shown in FIG. 1 and indicated by reference character 10. Boardsailer 10 is standing on a sailboard 11 to which a mast 12 is affixed through a universal joint 13 shown in FIG. 3. A boom 14 is affixed at its nose 15 to mast 12, and at the clew 16 to sail 17.

Figure 4:
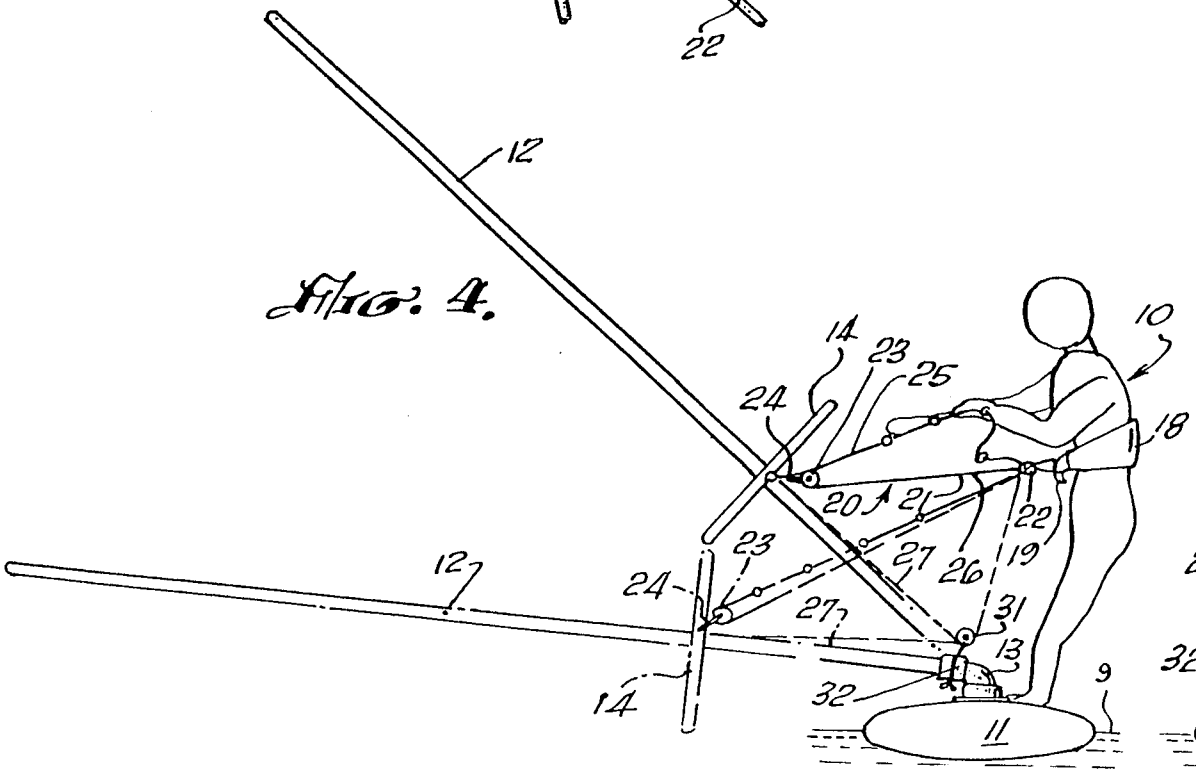
FIG. 4 is a view from the front of the sailboard of FIG. 1 showing the user lifting the sail from the water.
Figure 6:
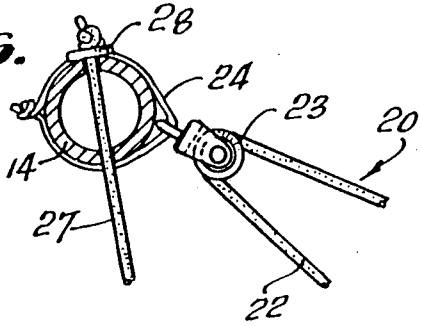
FIG. 6 is an enlarged cross-sectional view showing the attachment of the elastic cord and the upper pulley to the boom.

The process of raising the sail using the uphauler of the present invention is shown in FIGS. 2, 4 and 5. Boardsailer 10 is wearing a harness 18 which includes a downwardly directed harness hook 19. Harness 18 and harness hook 19 are conventional accessories and permit the boardsailer to release his hands from the boom and be supported by a loop on the boom which has been placed in the harness hook. The present invention utilizes this conventional harness hook to facilitate the raising of the sail from the water 9. As shown in FIG. 3, the uphauler assembly includes an uphauler line 20 which is formed into a large loop 21 which has a small loop 22 at its lower end. Uphauler line 20 passes through an upper pulley 23 which is affixed through a cord 24 to the nose 15 of boom 14. Large loop 21 has a knotted half 25 and a smooth half 26. Line 20 is preferably of relatively large diameter to make it easier to grasp. It has been found that a 7/16th inch outside diameter line provides a very comfortable grip. An elastic cord 27 is affixed at its upper end 28 to the nose 15 of boom 14 and at its lower end 29 to the base 30 of large loop 21. Elastic cord 27 passes through lower pulley 31 which is affixed near the base 32 of mast 12. Preferably, small loop 22 is covered by a length of plastic tubing 33 to improve wear characteristics.

Returning now to FIG. 2, boardsailer 10 has grasped small loop 22 and placed it in harness hook 19. This causes elastic cord 27 to stretch as shown in FIG. 2. The boardsailer next grasp the knotted half 25 of large loop 21 as also shown in FIG. 2. Turning now to FIG. 4, boardsailer 10 continues to pull on the knotted half 25, thereby raising the mast and sail from the surface of the water. It can be readily seen by viewing FIG. 4 that the force required by the boardsailer's arms is reduced by fifty percent by the use of the pulley. Once the mast has been fully raised, as shown in FIG. 5, the boardsailer can grasp the boom 14 and release the knotted half 25. Elastic cord 27 then pulls the small loop 22 from harness hook 19 and draws the uphauler assembly generally against the front of mast 12 as shown best in FIG. 3. The assembly is, thus, held neatly out of the way and yet the small loop 22 is readily available to the boardsailer when needed to raise the sail from the surface 9 of the water.

The currently accepted method of uphauling is to pull the entire rig up by bending over and tugging on a rope tied to the nose of the boom. This exerts extreme hardship on the arms, legs and lower back. In the learning stage, this task is especially tiresome and exhausting.

The arms of the user are particularly fatigued. By the use of the uphauler assembly of the present invention, the force required by the user's arms is cut in half. Since the arms of many beginners become exhausted before they have had an opportunity to tire of practicing, the process of learning the sport of boardsailing takes more time than necessary. By the use of the uphauler assembly of the present invention, the uphauling process is much easier and so the learning session is not cut short.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved uphauler assembly for use in facilitating the uphauling of the sail of a sailboard by a boardsailer wearing a harness including a harness hook, said sailboard being of the type having a board, a mast connected to the board, said mast having a base, a sail affixed to the mast, a boom including a nose, said boom being affixed to the mast, wherein the improvement comprises:

an upper pulley affixed adjacent the nose of the boom;

a lower pulley affixed near the base of the mast;

an uphauler line formed in a large loop, said uphauler line passing through said upper pulley and said uphauler line including a small loop, said large loop extending about from the upper pulley to the lower pulley;

an elastic cord having an upper end and a lower end, said elastic cord being affixed at its upper end to the nose of the boom, passing through the lower pulley and affixed at its lower end to the uphauler line near said small loop thereof, said elastic cord being of sufficient length and elasticity to pull said uphauler line into a flat loop when the assembly is in a released configuration and to stretch sufficiently to permit the small loop to be hooked onto the harness hook of a boardsailer, whereby the sail may be uphauled by grasping the small loop and hooking it onto the harness hook, next, one side of the large loop is grasped and pulled inwardly by the boardsailer to provide the mechanical advantage of the pulley to assist the boardsailer to uphaul the sail and when the sail is fully raised, the uphauler assembly is retracted by the elasticity of the elastic cord which pulls the large loop against the mast.

2. The uphauler assembly of claim 1 wherein one side of said large loop has a plurality of gripping enlargements thereon.

3. The uphauler assembly of claim 2 wherein said gripping enlargements are knots.

4. The uphauler assembly of claim 1 wherein said uphauler line has an outside diameter of about 7/16ths of an inch.

5. The uphauler assembly of claim 1 wherein said elastic cord is about ¼th of an inch in diameter.

6. The uphauler assembly of claim 1 wherein said upper pulley is held to the boom by a cord firmly affixed to the boom.

7. The uphauler assembly of claim 1 wherein said small loop is covered with a flexible plastic tube.

* * * * *